US006871825B2

(12) United States Patent
Song

(10) Patent No.: US 6,871,825 B2
(45) Date of Patent: Mar. 29, 2005

(54) PAINT BRUSH HOLDER

(76) Inventor: Chin Ho Song, 9922 Clovis Rd., Phelan, CA (US) 92329

( * ) Notice: Subject to any disclaimer, the term of this patent is extended or adjusted under 35 U.S.C. 154(b) by 0 days.

(21) Appl. No.: 10/382,211

(22) Filed: Mar. 5, 2003

(65) Prior Publication Data

US 2004/0173718 A1 Sep. 9, 2004

(51) Int. Cl.[7] ..... A46B 17/02
(52) U.S. Cl. ..... 248/113; 248/110; 248/213.2
(58) Field of Search ..... 248/213.2, 110, 248/112, 113; 211/65, 66; 220/637, 700; 15/145, 257.01

(56) References Cited

U.S. PATENT DOCUMENTS

| | | | | |
|---|---|---|---|---|
| 955,646 | A | | 4/1910 | Jorey |
| 1,624,426 | A | | 4/1927 | Mumaw et al. |
| 1,643,661 | A | | 9/1927 | Kendall |
| 1,703,008 | A | | 2/1929 | Justice |
| 2,402,374 | A | | 6/1946 | Corn et al. |
| 2,436,924 | A | | 3/1948 | Hansen |
| 2,469,864 | A | | 5/1949 | Craft et al. |
| 2,489,875 | A | | 11/1949 | Embree |
| 2,533,354 | A | | 12/1950 | Comfort |
| 2,533,355 | A | | 12/1950 | Comfort |
| 2,535,260 | A | | 12/1950 | Braswell |
| 2,567,326 | A | | 9/1951 | Entsminger |
| 2,643,046 | A | | 6/1953 | Humphreys |
| 2,675,979 | A | | 4/1954 | Vetterli et al. |
| 2,745,570 | A | | 5/1956 | Miller |
| 3,275,187 | A | | 9/1966 | Lamoureaux |
| 3,531,073 | A | | 9/1970 | Cortina |
| 3,948,413 | A | | 4/1976 | Gorrell et al. |
| 4,014,453 | A | | 3/1977 | Tarnacki |
| 4,121,798 | A | | 10/1978 | Schumacher et al. |
| 4,266,686 | A | * | 5/1981 | Carter ..... 220/90 |
| 4,275,818 | A | | 6/1981 | Church |
| 4,757,568 | A | * | 7/1988 | Jones ..... 15/105 |
| 4,982,471 | A | | 1/1991 | Bannan |
| 4,993,671 | A | | 2/1991 | Ste. Marie |
| 5,375,736 | A | | 12/1994 | Gonzalez et al. |
| D358,691 | S | | 5/1995 | Engle |
| D374,751 | S | | 10/1996 | Vong |
| 5,568,879 | A | | 10/1996 | Kovathana |
| D383,272 | S | | 9/1997 | McDonald |
| 5,823,483 | A | | 10/1998 | Gaskill |
| 6,175,987 | B1 | | 1/2001 | Harvey |
| 6,237,802 | B1 | | 5/2001 | Douglas |
| 6,394,285 | B1 | | 5/2002 | Arthurs et al. |
| D459,848 | S | | 7/2002 | Anderson |
| 6,419,194 | B1 | | 7/2002 | LoSacco et al. |
| D461,609 | S | | 8/2002 | Sands |
| 6,446,829 | B1 | | 9/2002 | Malvasio et al. |

FOREIGN PATENT DOCUMENTS

| | | | | |
|---|---|---|---|---|
| CA | 02227127 | * | 3/1998 | |
| CA | 2300317 | * | 3/2001 | ..... A46B/17/02 |
| FR | 2818512 A1 | | 6/2002 | |
| GB | 2160093 A | * | 12/1985 | ..... A46B/17/02 |
| GB | 2282663 A | * | 4/1995 | ..... E21B/47/00 |
| WO | WO0174607 A1 | * | 11/2001 | ..... B44D/3/12 |
| WO | WO-2051286 A1 | | 7/2002 | |

* cited by examiner

*Primary Examiner*—Gwendolyn Baxter
(74) *Attorney, Agent, or Firm*—Fulbright & Jaworski LLP

(57) ABSTRACT

A paint brush holder for suspending a paint brush in a conventional paint can having a grooved, cover-sealing rim. The holder comprises a body portion and a pair of brush-supporting arms integrally connected to the body portion. The arms have opposed surfaces for receiving a paint brush handle therebetween, the opposed surfaces defining an opening having a mouth, a base narrower than the mouth, and sides that converge from the mouth to the base. A cooperating pair of extensions project downward from the body portion for attachment to the paint can rim.

3 Claims, 6 Drawing Sheets

PAINT BRUSH HOLDER

BACKGROUND

1. Field of the Invention

This invention relates generally to painting aids and, more particularly, to a paint brush holder for holding a paint brush over the interior of a paint can.

2. Related Art

In the process of decorative painting with a paint brush, paint is loaded on the brush by dipping the brush into a filled paint can. When painting is interrupted and the brush put down, excess paint on the brush can splatter or the bristles of the brush can dry out. To prevent these problems, the brush can be suspended over the paint can to catch the excess paint, or the bristles can be kept moist by suspending the brush into the paint contained in the paint can.

A number of paint brush holders that vertically suspend a paint brush in a paint can have been developed. In many cases, these devices suffer from one or more of the following drawbacks: unstable attachment to the paint can; brush gripping elements that require the use of two hands to easily release the brush; brush supporting arms that fail to hold the paint brush securely; cumbersome construction and awkward use; and uneconomical fabrication.

SUMMARY

It is an object of the present invention to avoid many of the drawbacks of previous paint brush holders. Thus, the present invention is directed to an easy to use, simply constructed paint brush holder for suspending a paint brush inside a paint can.

The paint brush holder of the present invention attaches to a conventional paint can well known in the industry, having a grooved annular cover-sealing rim with an associated outer bead and an associated inner lip. The paint can typically has a capacity of one gallon or less. Other kinds and sizes of paint containers can be suitable as long as they have similar grooved annular cover-sealing rims.

In accordance with the present invention, the paint brush holder comprises a body portion and a pair of brush-supporting arms integrally connected to the body portion. The arms have opposed surfaces for receiving a paint brush handle therebetween, and the opposed surfaces define an opening having a mouth, a base narrower than the mouth, and sides that converge from the mouth to the base. A cooperating pair of extensions project downward from the body portion for attachment to the paint can rim, one extension engaging the outer bead, the other extension engaging the inner lip. The holder can be made of any suitable material such as plastic, metal, wood, synthetic polymers such as polycarbonate and polypropylene, and the like.

DETAILED DESCRIPTION

Figure 1:
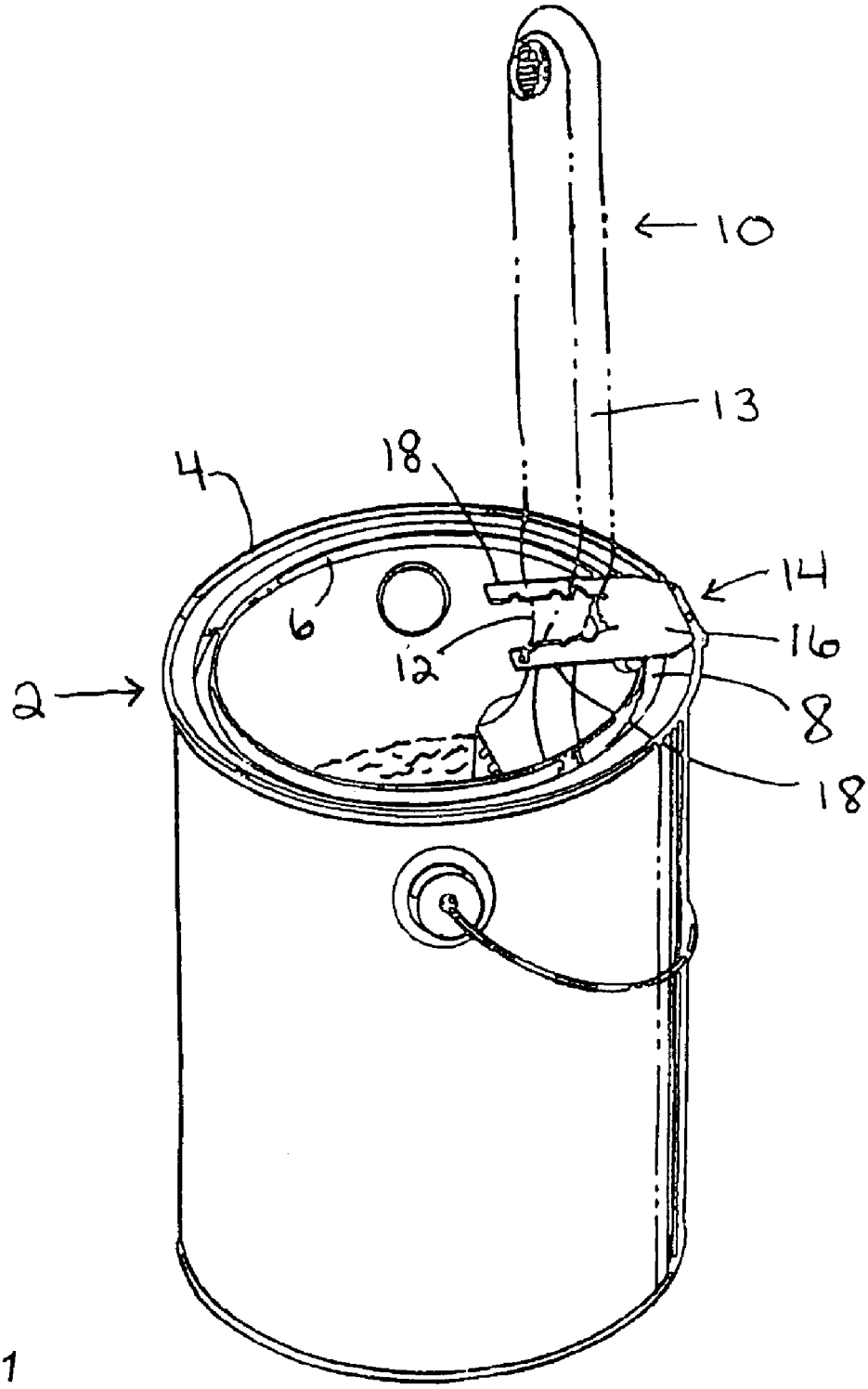
FIG. 1 is a perspective view of the paint brush holder of the present invention attached to a conventional paint can.
Figure 2:
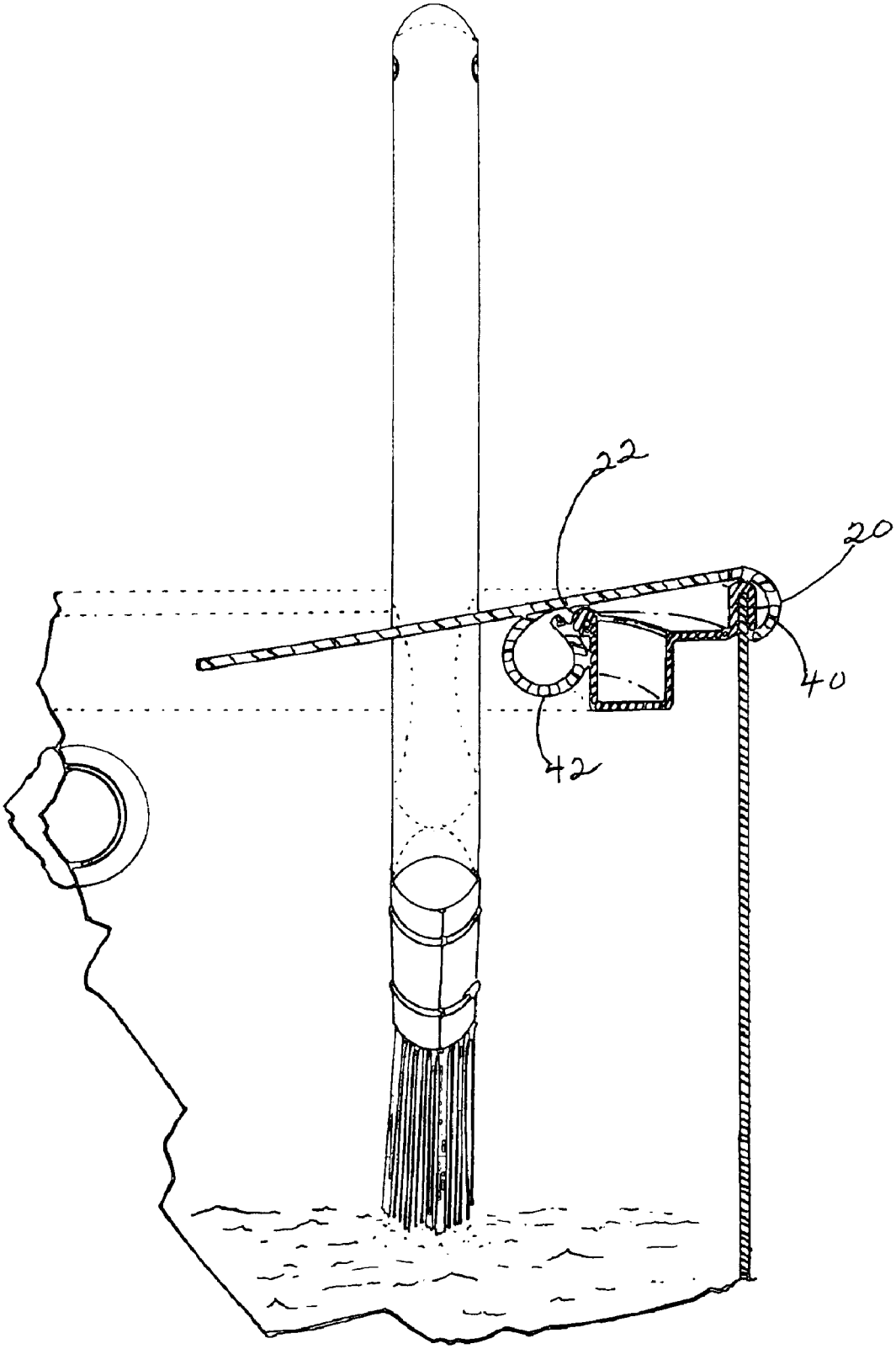
FIG. 2 is a side view of the paint brush holder of the present invention suspending a conventional paint brush over a paint can.

Referring to FIG. 1 showing an embodiment of the present invention, a conventional paint can including an annular cover-sealing rim 2 having an outer rim 4, an inner flange 6, and an annular groove 8 positioned between and connected to the outer rim and inner flange, is shown. Referring to FIG. 2, an outer bead 20 is associated with the outer rim, and an inner lip 22 is associated with the inner flange. Also shown in FIG. 1 is a vertically suspended, conventional paint brush suitable for use with the present invention, having a handle 10 with a narrow neck 12 and rounded sides 13.

Figure 3:
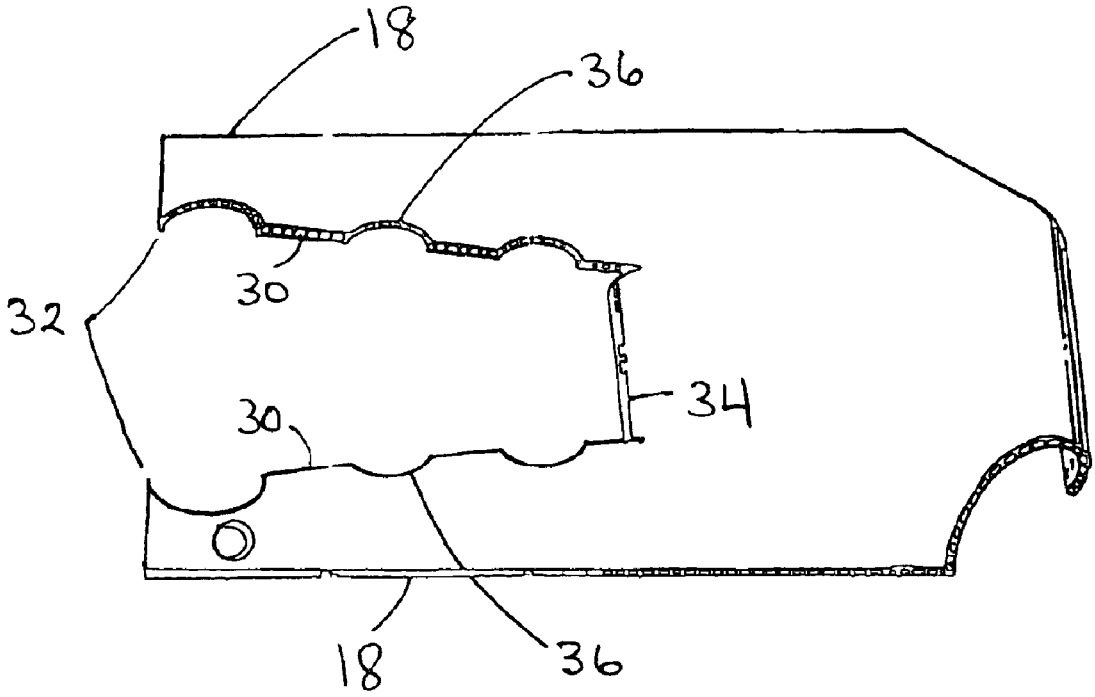
FIG. 3 is a perspective view showing the top surface of the paint brush holder of the present invention.

Referring again to FIG. 1, in accordance with the present invention, the paint brush holder 14 includes a body portion 16 and a pair of brush-supporting arms 18 integrally connected to the body portion 16. Referring to FIG. 3, the arms 18 have opposed surfaces 30 that define a generally trapezoid-like opening comprising a mouth 32, a base 34 narrower than the mouth, and sides that converge from the mouth to the base. The mouth 32 is sized to permit unobstructed entry of the neck of a conventional paint brush handle, and the converging opening is dimensioned to receive brush handles of various sizes, with larger handles being held closer to the mouth 32 and smaller handles being held closer to the base 34.

The opening of the paint brush holder is dimensioned to receive the neck of variously sized brush handles without having to change the shape or size of the opening. As the handle moves from the mouth 32 toward the base 34 of the opening, the holder is designed to grip the brush where the handle makes contact with the converging opposed surfaces 30 of the arms 18. As shown in FIG. 1, the arms are designed to contact the sides 13 of the paint brush handle. Although the brush-supporting arms 18 can be resilient, the generally fixed shape of the opening permits the use of non-resilient arms. In contrast, other paint brush holders depend on the resiliency of brush-supporting arms to guide and secure paint brush handles.

To enhance brush holding ability, interruptions such as notches or teeth can be introduced into the opposed surfaces 30 of the arms, thereby increasing interference between the surfaces and the brush handle. In addition, as shown in the embodiment of FIG. 3, the opposed surfaces 30 can contain one or more pairs of opposing notches 36, each notch of suitable dimension to receive and contact the side 13 of a paint brush handle. The sides 13 are inserted into a pair of opposing notches after the handle enters the opening. Preferably, the opposed surfaces contain three pairs of opposing notches.

A pair of extensions that cooperate together to attach the holder to the paint can rim project downward from the underside of the body portion 16. Referring to an embodiment in FIG. 2, a curved extension 40 engages the outer bead 20 of the rim, while a curled extension 42 engages the inner lip 22 of the flange. The spacing of the extensions is dependent on the distance between the outer rim and inner flange. Other suitable extensions, straight or curved, such as flanges, posts, legs and lips are well known in the art. The appropriately spaced paired extensions can be positioned at various underside locations in accordance with the dimensions of the body portion 16. As shown in the bottom view of FIG. 4, a preferred curved extension 50 for engaging the outer bead 20 is continuous with a side of the body portion 16 generally opposite the brush supporting arms 18. In this embodiment of the invention, the curved extension ends in an inwardly directed curved lip 52 that hooks under the outer bead. Also shown is a preferred curled extension 54 for engaging the inner flange lip 22. A region of the curled extension engages the inner flange lip, as shown in FIG. 2.

Figure 5:
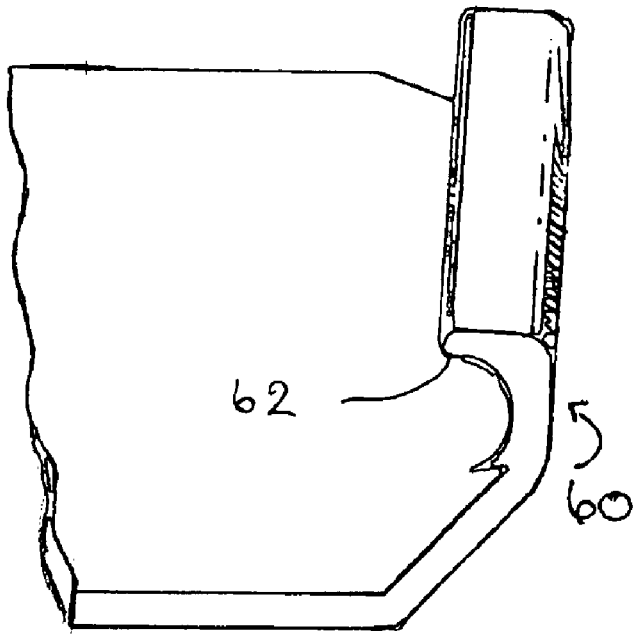
FIG. 5 is a partial perspective view of the bottom surface of an embodiment of the paint brush holder of the present invention.

Referring to FIG. 5, in some embodiments of the present invention, the curved extension 50 is replaced by a straight flange 60 having an inwardly directed lip 62. In other embodiments, a straight flange having an inner lip-engaging ridge can replace the curled extension 54.

Figure 6:
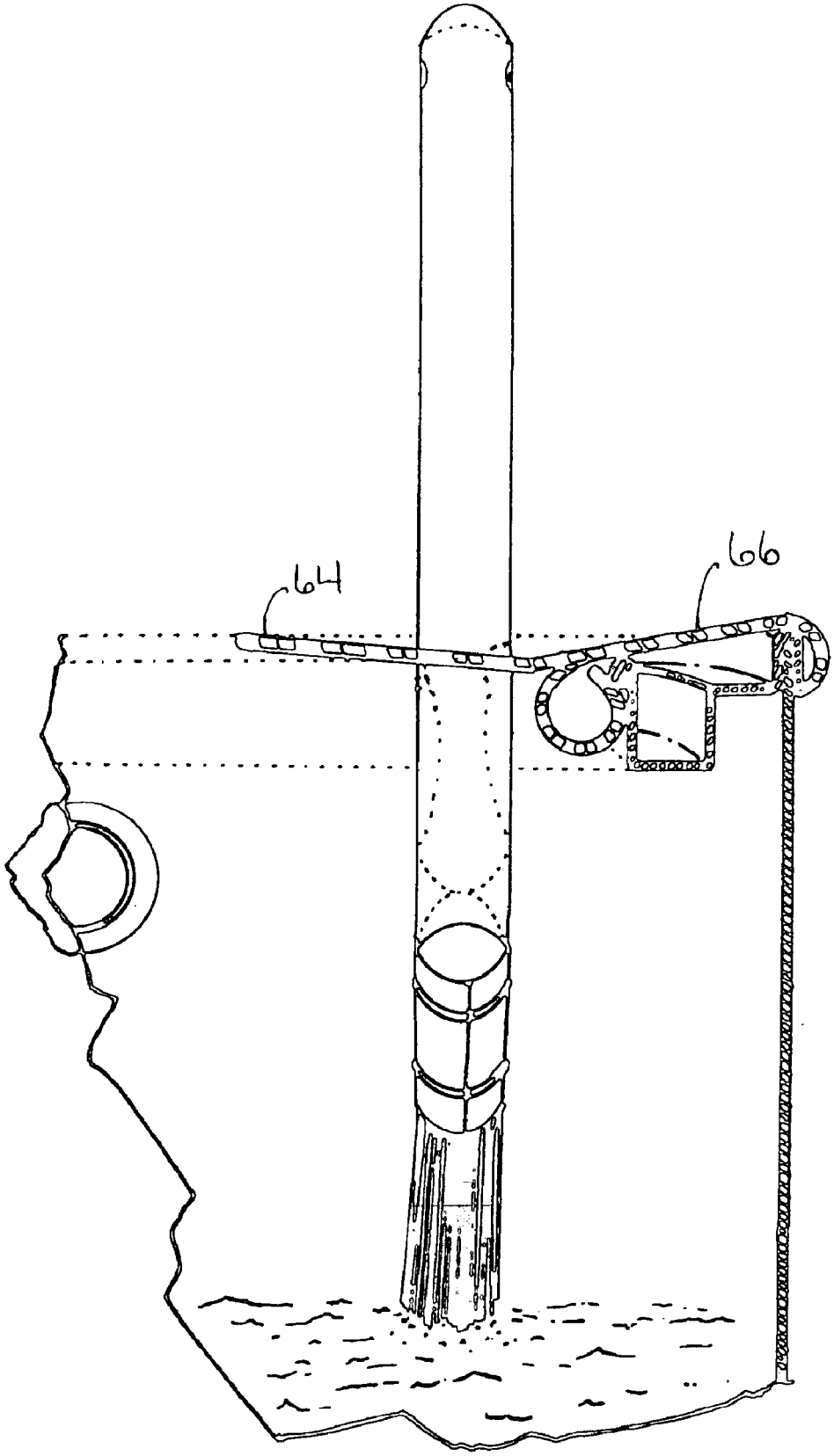
FIG. 6 is a side view of an embodiment of the paintbrush holder of the present invention.

Preferred embodiments of the present invention have generally planar horizontal body portions and generally planar, brush-supporting arms. Although the generally planar arms can extend upwardly or downwardly from the horizontal body portion at any angle that permits suspension of a paint brush, preferably, the arms are coplanar with the body portion, as shown in FIG. 3. An embodiment having upwardly directed arms 64 relative to the body portion 66 is show in FIG. 6.

The paint brush holder of the present invention can be of any dimension that allows the holder to suspend a paint brush over the interior of a paint can. Preferred dimensions for the opening of a holder having arms coplanar with the body portion, such as the holder of FIG. 3, are a base of about 15/32 inches, a mouth of about 11/16 to 3/4 inches, and a perpendicular distance from mouth to base of about 3/4 to 15/16 inches.

As shown in FIG. 1, the body portion 16 rests on the outer rim 4 and inner flange 6 of the paint can rim. The angle that a generally planar body portion makes relative to the plane of the rim depends on the relative heights of the outer rim and inner flange. With conventional paint cans, the top of the inner flange is slightly below the top of the outer rim, and the body portion is angled about 3 degrees from horizontal, as shown in FIG. 2. Other containers having greater differences in outer rim and inner flange heights are suitable as long as the paint brush holder can retain a paint brush between its brush-supporting arms when attached to the container rim.

Figure 4:
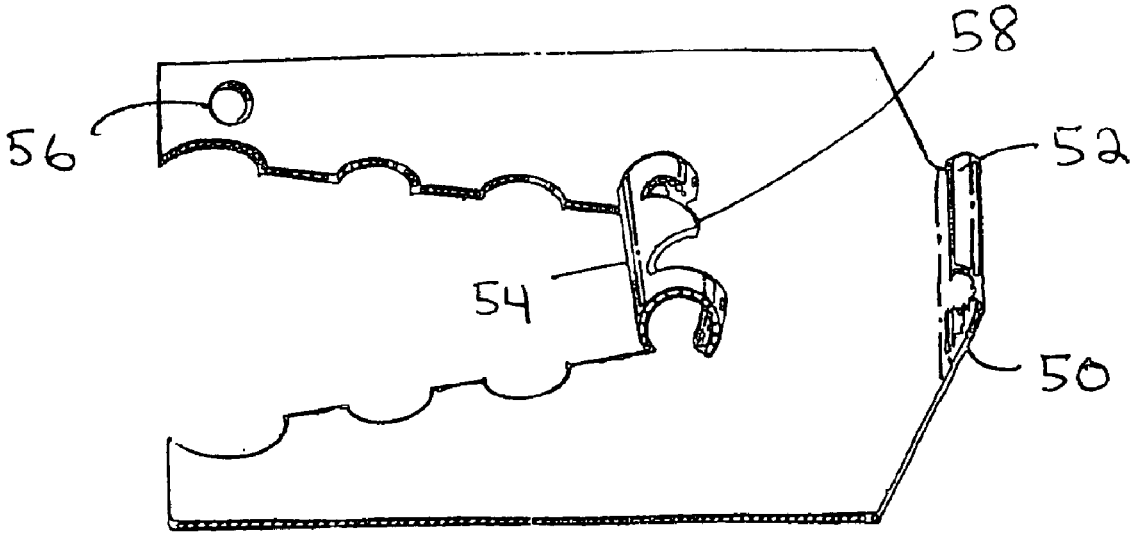
FIG. 4 is a perspective view showing the bottom surface of the paint brush holder of the present invention.

As shown in FIG. 4, the paint brush holder can contain a hole 56 for convenient attachment to a key chain. In addition, the curled extension 54 can be designed to include a bottle cap opener 58. Also, the inwardly directed curled lip 52 can be of sufficient dimensions to act as a paint can opener that fits between the rim and cover of a paint can.

What is claimed:

1. A paint brush holder adapted to suspend a paint brush in a paint can having a grooved rim with an associated outer bead and associated inner lip, the holder comprising:

a generally planar body portion;

a pair of generally planar brush-supporting arms coplanar with and integrally connected to the body portion, said arms having opposed surfaces for vertically receiving the paint brush handle therebetween, the opposed surfaces defining an opening having a mouth, a base narrower than the mouth, and sides that converge from the mouth to the base, and having three pairs of opposed notches for contacting both sides of the paint brush handle; and a cooperating pair of extensions projecting downward from the body portion for attachment to the paint can rim, one extension for engaging the outer bead and extending continuously from a side of the body portion opposite the brush-supporting arms, the other extension for engaging the inner lip;

wherein the inner lip engaging extension is curled to form a curved region for engaging the inner lip, the curled extension including a bottle cap opener.

2. The holder of claim 1 having a hole for attachment to a key chain.

3. The holder of claim 1 wherein the outer bead engaging extension is inwardly curved and terminating in an inwardly directed lip for engaging the outer bead, the inwardly directed lip of sufficient dimension to open a covered paint can by fitting between the paint can's rim and cover.

* * * * *